United States Patent [19]

Marzoli

[11] 3,990,222

[45] Nov. 9, 1976

[54] DEVICE FOR REMOVING COPS IN ROVING FRAME

[75] Inventor: Angelo Marzoli, Bergamo, Italy

[73] Assignee: F. Lli Marzoli & C. S.p.A., Palazzolo Sull'Ogllo (Brescia), Italy

[22] Filed: May 19, 1975

[21] Appl. No.: 579,074

[30] Foreign Application Priority Data

June 18, 1974 Italy ..... 24109/74

[52] U.S. Cl. ..... 57/52; 57/54

[51] Int. Cl.[2] ..... D01H 9/00; D01H 9/14

[58] Field of Search ..... 57/52–54, 57/34 R

[56] References Cited

UNITED STATES PATENTS

| | | | |
|---|---|---|---|
| 1,695,659 | 12/1928 | Mackie | 57/52 |
| 1,752,678 | 4/1930 | Mackie | 57/52 |
| 1,823,374 | 9/1931 | Porter | 57/52 |
| 1,840,923 | 1/1932 | Stutz-Benz | 57/52 |
| 2,076,423 | 4/1937 | Anderson | 57/52 |
| 2,541,503 | 2/1951 | Crossman et al. | 57/52 |
| 2,819,580 | 1/1958 | Teupel | 57/52 |

*Primary Examiner*—John Petrakes

*Attorney, Agent, or Firm*—Haseltine, Lake & Waters

[57] ABSTRACT

There is disclosed a device for removing cops in roving frames in which the cops are formed by the combined action of a vertically reciprocable carriage and a flyer suspended above each rotatable tube contained in a cop support bed of the carriage. According to the invention, the cop support bed is pivoted to the carriage in such a manner as to swing in the direction of removal of the cops, means being provided to automatically induce this swing when the carriage is in the completely lowered position. By so doing, the cop removal is made more simple, while the overall dimensions of the machine are not altered.

3 Claims, 2 Drawing Figures

DEVICE FOR REMOVING COPS IN RONING FRAME

BACKGROUND OF THE INVENTION

This invention relates to a device for facilitating manual removal of cops in roving frames, the cops comprising a wound roving originating, for example, from a drawing frame.

The constant progress made in roving frames towards the attainment of ever increasing rotational speeds of the flyers and spindles has notably led to the use of suspended flyers and to the provision of flyers of closed cap shape surrounding the cop being formed, whether or not the flyer drive is separate from the spindle drive.

The use of suspended flyers, especially of the closed type, has led to the great advantage of a considerable increase in production speed, but has made the cop removal operation difficult, with consequent loss of time and reduction in machine efficiency.

In this respect, the flyers lying above the tubes and coaxial with them prevent free withdrawal of the cops when the cop support carriage is in its lowered position, this latter, as is well known to experts of this art, being driven vertically with reciprocating motion to give correct winding of the roving on the tube.

The operator has to bend over the carriage and, having overcome the obstacle of the relative overlying flyer, is obliged to incline the cop laterally with respect to the spindle in order to remove the cop from the bed.

The object of the invention is consequently to make the removal operation more simple without however altering the overall dimensions of the machine.

SUMMARY OF THE INVENTION

This object is attained according to the invention by a roving frame wherein the cop support beds are mounted on the carriage in such a manner as to swing in the direction of removal of the cops, means being provided to automatically induce this swing when the carriage is in the completely lowered position.

In a preferred embodiment of the invention, the swing of the cop support beds is induced by a striker which when the carriage is completely lowered is located at a higher level than that of the point of pivoting between the carriage and bed, and which acts on this latter in a zone opposite said pivoting.

This striker may be in the form of an idle roller, preferably adjustable in height.

For a better understanding of the structural and operational characteristics of the invention and its advantages with respect to known techniques, a preferred embodiment is hereinafter described with reference to the accompanying diagrammatic drawings, in which:

DESCRIPTION OF THE PREFERRED EMBODIMENTS

Figure 1:
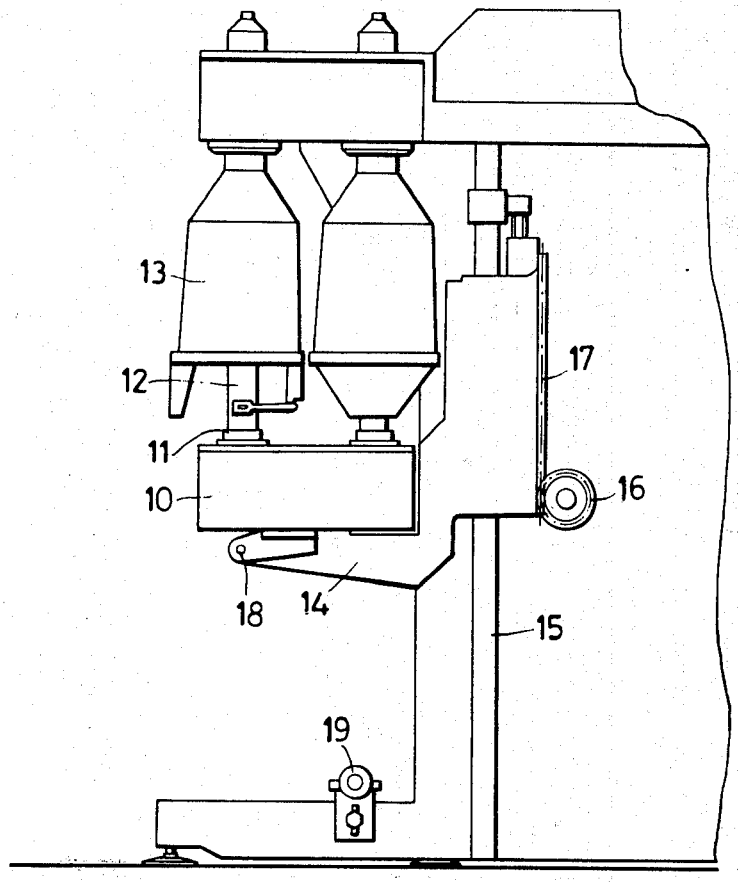
FIG. 1 is a lateral elevational view showing a roving frame incorporating the invention in the working position in which the rolling is being wound on to the tube.

With reference to the drawings, the roving frame shown comprises a bed 10 with fixing means 11 into which are removably inserted tubes 12 around which is wound the roving, originating from an upstream drawing frame (not shown).

The roving is wound on each tube in known manner by means of a so-called "flyer" 13, suspended above it, and which in the roving frame shown here is in the form of a cap coaxial with the tube.

To form the cops the bed 10 is moved with reciprocating motion in the vertical direction. To this end the bed is mounted on a carriage 14 driven along a vertical guide 15 by means of a mechanism comprising a pinion 16 and rack 17. Other drive systems may however be used.

According to the invention the bed 10 is linked to the carriage 14 in a manner such that it can swing about 18 in the cop removal direction, when the carriage is in the completely lowered position. This swing may be induced by a striker 19 which, when the carriage is in the completely lowered position (FIG. 2), is located at a level above that of the point of pivoting 18 and acts in a zone of the bed 10 which is opposite 18.

In the example shown, the striker 19 is in the form of an idle roller adjustable in height.

Figure 2:
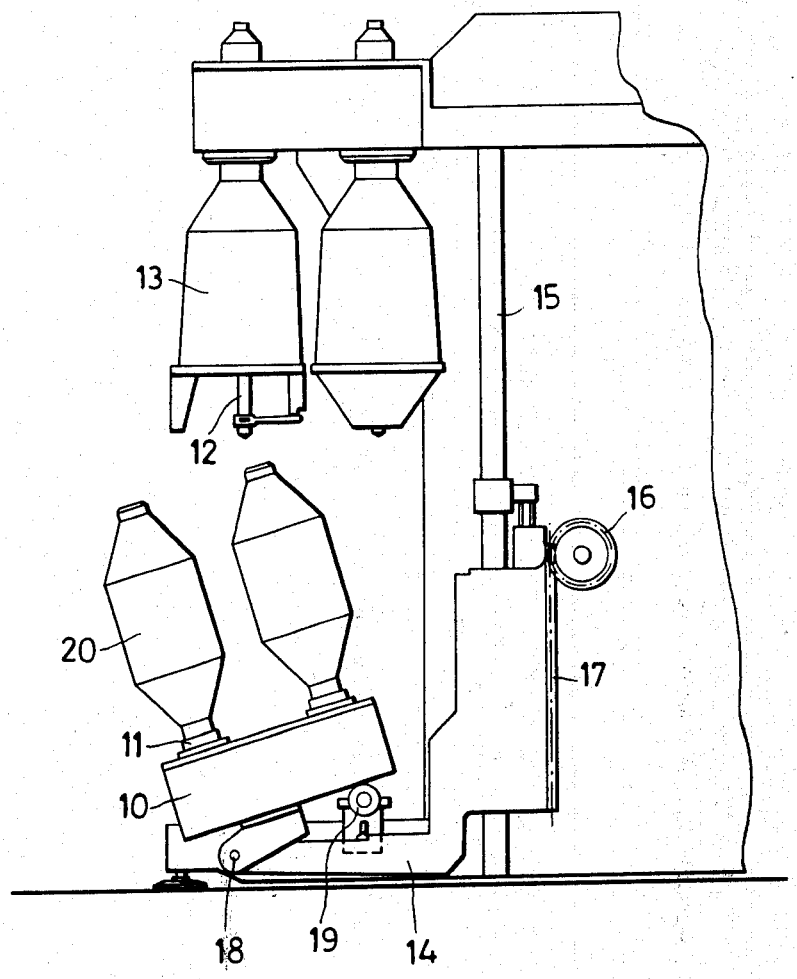
FIG. 2 is a view showing the same spindle frame as in FIG. 1, but in the position for cop removal.

When the cops have been formed, the carriage is lowered into the removal position shown in FIG. 2. In this position the bed 10 encounters the striker 19 and is compelled to swing about 18 in an anti-clockwise direction, through a certain angle determined by the difference in level between 18 and 19, to bring the cops 20 into a position inclined towards the operator and outside the influence of the overlying flyers 13, where they can be freely withdrawn axially from the spindle.

What I claim is:

1. In a roving frame comprising a cop support bed, a suspended flyer arranged above each cop, a bed support carriage and driving means for vertically reciprocating the carriage with respect to the flyers, the improvement comprising connecting pivot means inserted between the cop support bed and said carriage to allow said bed to rotate laterally with respect to said carriage for removal of the cops, and a striker arranged in a fixed position below said carriage for engaging the cop support bed to produce rotation thereof to an inclined removal position when said carriage is moved to a lower end position.

2. A roving frame according to claim 1, wherein said striker is located at a level higher than the level of said pivot means when said carriage is in said lower end position.

3. A roving frame according to claim 2, wherein said striker comprises an idle roller with means for adjusting the height thereof.

* * * * *